United States Patent [19]

Katz

[11] Patent Number: 5,042,371

[45] Date of Patent: Aug. 27, 1991

[54] NEWSPAPER STORAGE AND BUNDLING RACK

[76] Inventor: Philip R. Katz, 743 Ridge Road Ter., Kinnelon, N.J. 07405

[21] Appl. No.: 529,334

[22] Filed: May 29, 1990

[51] Int. Cl.[5] ..... B65B 13/02

[52] U.S. Cl. ..... 100/15; 100/34; 211/50; 211/58; 211/164

[58] Field of Search ..... 100/8, 15, 34, 212; 211/50, 58, 164, 51, 53

[56] References Cited

U.S. PATENT DOCUMENTS

| | | | |
|---|---|---|---|
| 392,106 | 10/1888 | Clark | 100/15 |
| 431,080 | 7/1890 | Shute | 100/34 X |
| 504,254 | 8/1893 | Skaggs | 211/164 X |
| 1,166,243 | 12/1915 | Norton et al. | 100/15 X |
| 2,639,037 | 5/1953 | Friend | 100/34 X |
| 2,811,916 | 11/1957 | Guilleminot et al. | 100/15 |
| 2,818,180 | 12/1957 | Keene | 100/34 X |
| 2,912,151 | 11/1959 | Crabs | 211/51 X |
| 3,038,403 | 6/1962 | Orelind | 100/34 |
| 3,459,120 | 8/1969 | Brunette | 100/34 |
| 3,742,842 | 7/1973 | Pierens | 100/34 X |
| 3,994,118 | 11/1976 | Felix | 100/15 X |
| 4,154,159 | 5/1979 | Ortega | 100/34 |
| 4,155,213 | 5/1979 | Blanton et al. | 100/15 X |

FOREIGN PATENT DOCUMENTS

| | | | |
|---|---|---|---|
| 334407 | 3/1921 | Fed. Rep. of Germany | 100/15 |

*Primary Examiner*—Harvey C. Hornsby
*Assistant Examiner*—Stephen F. Gerrity
*Attorney, Agent, or Firm*—David L. Davis

[57] ABSTRACT

Apparatus for storing and bundling recyclable material includes rotatable containment members separated by a space, which support the recyclable material spanning the space. Rotation of the containment members allows bundling material lined up with the space to completely encircle the recyclable material without interference from the structure of the storage and bundling apparatus.

15 Claims, 3 Drawing Sheets

NEWSPAPER STORAGE AND BUNDLING RACK

BACKGROUND OF THE INVENTION

This invention relates to an arrangement for bundling newspaper and, more particularly, to such an arrangement which both stores and bundles newspapers and in addition can be made aesthetically pleasing in appearance.

In recent years, environmental concerns have resulted in an increased awareness of the need to recycle certain materials in order to save dwindling natural resources. One such material is paper, typically in the form of newspaper. In fact, many municipalities have recently instituted mandatory recycling programs which require that residents save and bundle their newspapers, which are then taken to a recycling center for processing.

Typically, municipalities require that the residents bundle their newspapers in stacks of height from 6" to 9", which bundles are then secured by twine, paper tape, or the like. In order to comply with these requirements, many homeowners merely place their newspapers in a pile until the pile reaches the desired stack height. The pile of newspapers is then secured. For many people, such as the aged and physically handicapped, this is a difficult task, since a 9" stack of newspaper weighs a considerable amount and it is difficult to manipulate so as to put the twine or paper tape beneath the bundle during the securing process. Accordingly, it is a primary object of the present invention to provide an arrangement which assists in the bundling of newspapers.

As was previously mentioned, prior to securing the newspapers in a bundle, they must be somehow stored. It is therefore another object of this invention to provide a newspaper bundling arrangement that provides storage for the newspapers prior to bundling.

A supply of previously read newspapers can be rather unsightly. It is therefore a further object of this invention to provide a newspaper bundling and storage arrangement so designed as to provide an aesthetically pleasing appearance.

SUMMARY OF THE INVENTION

The foregoing and additional objects are attained in accordance with the principles of this invention by providing apparatus for bundling newspapers and the like which comprises a base and a pair of upstanding side members. A support is mounted for rotation on each of the side members in a cantilevered manner. The supports extend toward each other with their axes of rotation being co-linear, there being a space between the supports, which space is bridged by a newspaper supported by the supports. When the desired amount of newspaper is held by the supports, the bundling material (i.e., twine or paper tape or the like) is secured to the newspaper and the supports are rotated about their co-linear axes, with the bundling material passing between the supports in the space which separates them, the bundling material thereby encircling the stack of newspapers.

In accordance with an aspect of this invention, there is further provided means for securing the newspapers to the supports so that the supports along with the newspapers supported thereby may be rotated as a unit without the newspapers falling therefrom.

In accordance with a further aspect of this invention, there is further provided an arrangement whereby the supports are releasable secured against rotation.

BRIEF DESCRIPTION OF THE DRAWINGS

The foregoing will be more readily apparent upon reading the following description in conjunction with the drawings in which like elements in different figures thereof have the same reference numeral and wherein.

DETAILED DESCRIPTION

Figure 1:
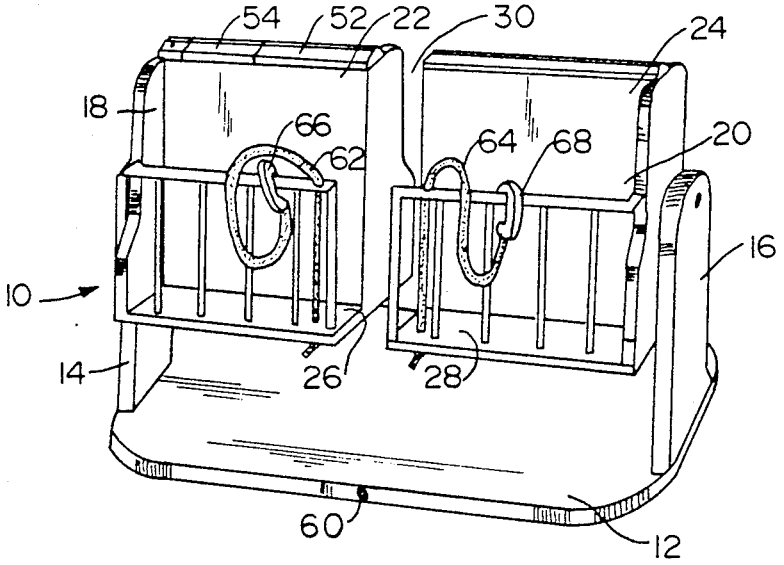
FIG. 1 is a perspective view of a first embodiment of a newspaper storage and bundling arrangement, combined with a magazine rack, according to the present invention.
Figure 2:
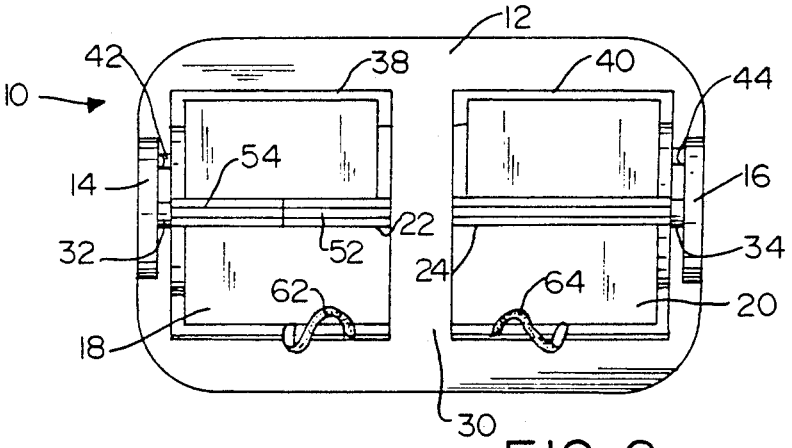
FIG. 2 is a top plan view of the arrangement shown in FIG. 1.

Referring now to the drawings, FIGS. 1–7 illustrate a first embodiment of apparatus constructed in accordance with the principles of this invention. As shown therein, such apparatus, designated generally by the reference numeral 10, includes a base 12 and a pair of side members 14 and 16 which are supported on the base 12. The side members 14 and 16 extend upwardly from the base 12 on opposite ends thereof. On each of the side members 14, 16 there is mounted for rotation in a cantilevered manner a respective support member 18, 20. As illustrated herein, each of the support members 18, 20 includes a respective planar wall 22, 24 and newspaper containment structure 26, 28 on one side of each of the respective walls 22, 24.

Figure 3:
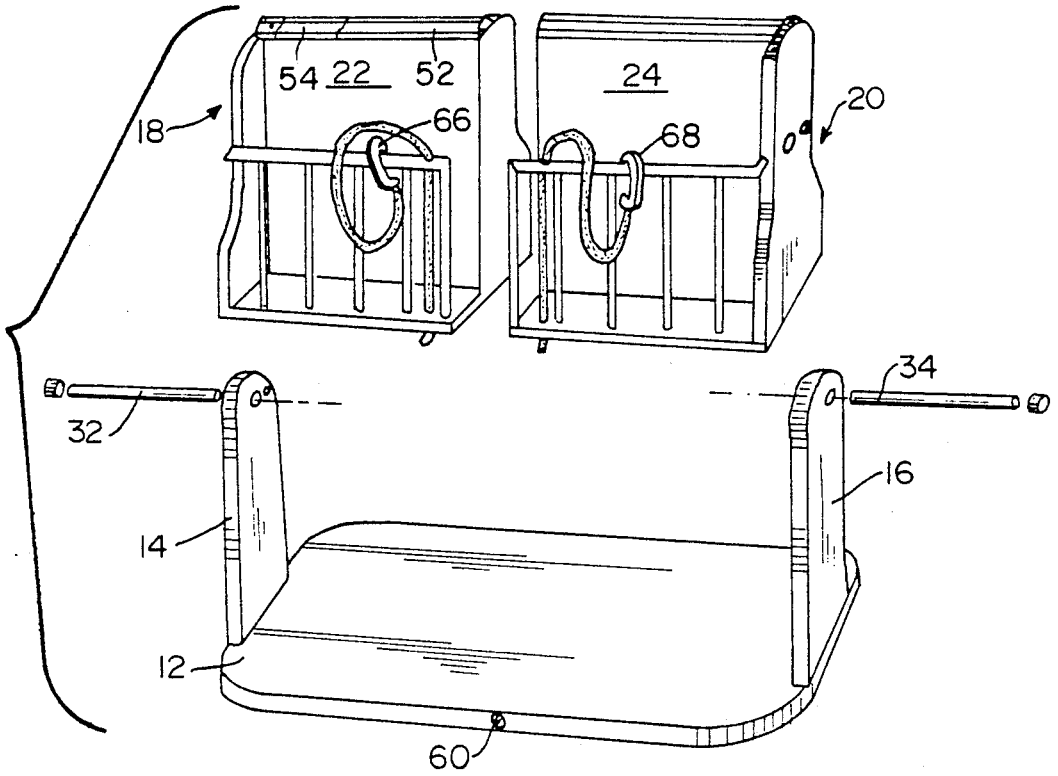
FIG. 3 is an exploded perspective view of the arrangement shown in FIG. 1 illustrating the rotational mounting of the supports on the side members.

The support members 18, 20 are mounted for rotation on their respective side members 14, 16 and extend toward each other, leaving a space 30 separating them. The axes of rotation of the support members 18, 20 are co-linear and, as illustrated in FIG. 3, the rotational mounting structure may include axles 32, 34 supported on the side members 14, 16 and extending parallel to the walls 22, 24 which are mounted thereon by structure not shown.

As shown in FIGS. 1–7, the newspaper containment structure 26, 28 illustratively takes the form of a three sided rack open toward the top and the space 30 so that newspaper 36 supported thereby spans the space 30. Illustratively, according to the first embodiment, on the other side of each of the planar walls 22, 24 there is provided a four sided magazine rack 38, 40. When the support members 18 and 20 are holding newspapers and magazines, it is desirable to secure the support members against undesirable rotation to prevent the newspapers and magazines from falling out. Accordingly, there may be provided between the support members 18, 20 and their respective walls 14, 16 detent means 42, 44 which may take the form of a spring loaded ball and socket arrangement.

Figure 5:
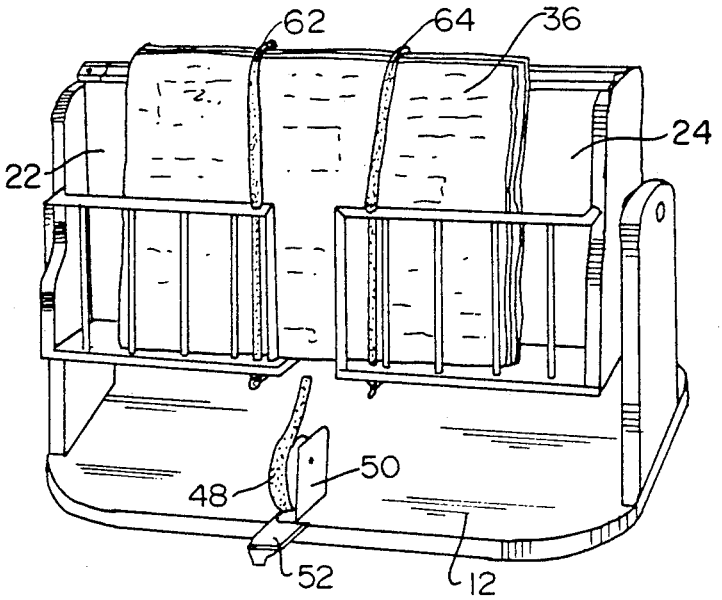
FIG. 5 is a perspective view of the arrangement shown in FIG. 1 wherein newspapers are supported by the supports and secured thereto, a supply of bundling tape is supported on the base, and tape is partially pulled out from the supply.

In use, when newspapers are ready for recycling, they are placed in the newspaper containment structure 26, 28, bridging the space 30, as shown in FIG. 5. At the same time, magazines may be stored in the magazine racks 38 and 40. Since magazines are typically more pleasant in appearance than used newspapers, the storage and bundling unit 10 may be so placed in a person's home that the newspaper storage side is against the wall and the magazine storage side is outwardly disposed so as to be visible, thereby presenting a more aesthetically pleasing appearance.

Figure 4:
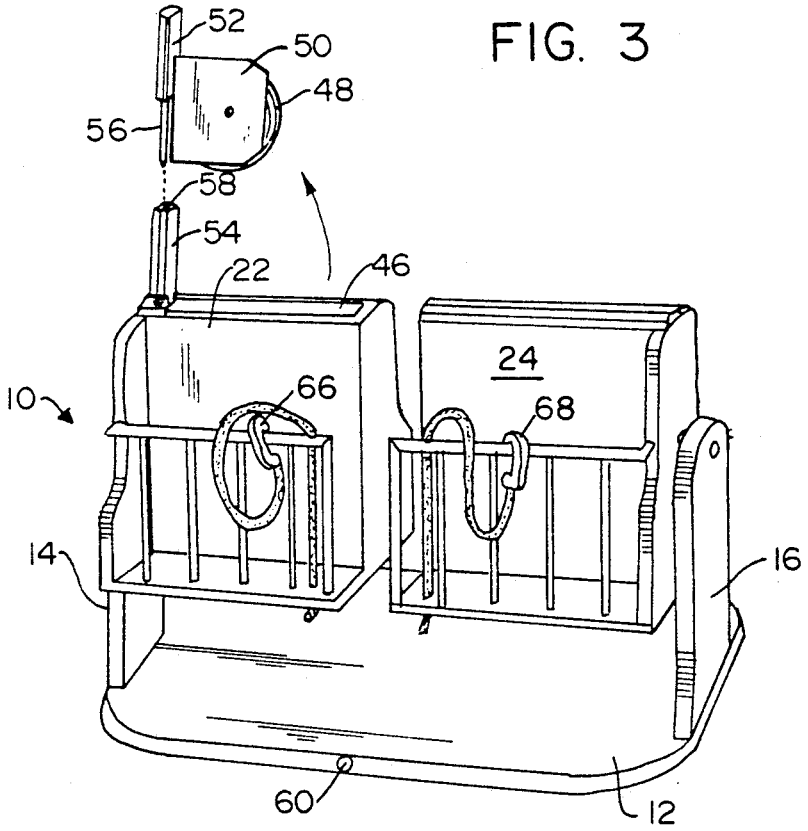
FIG. 4 is an perspective view of the arrangement shown in FIG. 1 with a supply of bundling tape partially extracted from a storage compartment.

When a sufficient amount of newspaper 36 fills the newspaper containment structure 26, 28, the unit 10 is used for bundling the newspaper so that it may be more easily handled for transport to a recycling center. A preferred material for securing a stack of newspaper into a bundle is paper tape, since this material need not be separated from the newspaper in the recycling process. Accordingly, as shown in FIG. 4, the unit 10 is provided with a storage compartment 46 behind the wall 22 for storing a supply 48 of paper tape. The tape supply 48 preferably comprises a standard roll of masking tape which is mounted for rotation on a plate member 50 which in turn is mounted on a base member 52 which forms a part of the cover of the storage compartment 46. The other part of the storage compartment cover is a member 54 hingedly mounted on the open side of the storage compartment 46. The base member 52 is provided with an extension 56 and the cover member 54 is provided with a recess 58 complemental to the extension 56. Thus, the extension 56 may be placed in the recess 58 and the base and cover members 52, 54 may together close off the storage compartment 46 with the supply of tape 48 contained therein. The base 12 of the unit 10 is provided with a recess 60 along an edge and aligned with the space 30. The recess 60 is also complemental to the extension 56 so that the extension 56 may be inserted therein to support the supply of tape 48 on the base 12 in line with the space 30, as shown in FIG. 5.

Figure 6:
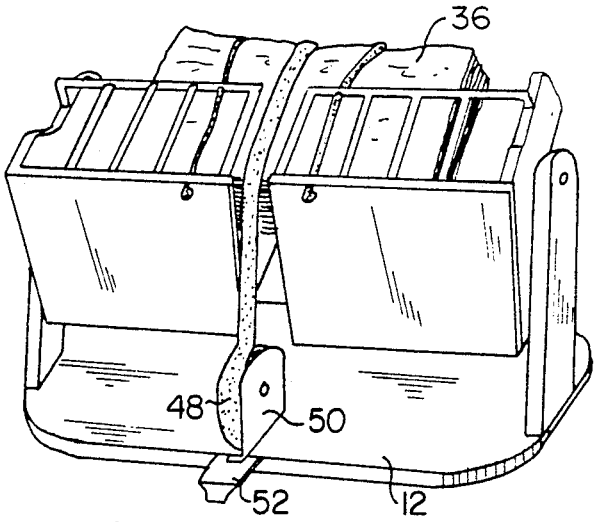
FIG. 6 is a perspective view like FIG. 5 showing partial rotation of the supports with tape from the supply secured to the newspapers.
Figure 7:
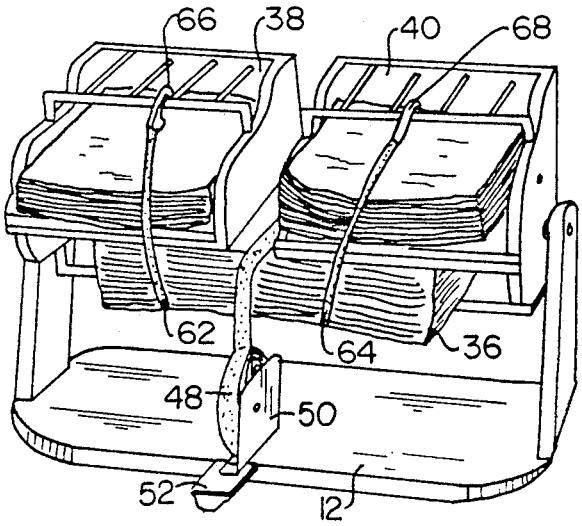
FIG. 7 is a perspective view like FIG. 6 after sufficient rotation of the supports that the bundling tape completely encircles the newspaper.

In accordance with this invention, there is also provided means for securing the newspaper 36 to the newspaper containment structure 26, 28 so that it is retained therein when the support members 18, 20 are rotated to effect the bundling operation. Since the embodiment shown in FIGS. 1–7 also includes magazine racks 38, 40, the magazines must also be secured within their racks. Toward this end, there is provided a pair of elastic cords 62, 64 secured at one end to the newspaper containment structures 26, 28, respectively. The other end of each of the elastic cords 62, 64 is terminated by a hook member 66, 68, respectively. Thus, as shown in FIGS. 5–7, when the newspaper 36 is ready for bundling, the elastic cords 62, 64 are extended over the newspaper 36 held within the newspaper containment structure 26, 28 and also over the magazines held in the magazine racks 38, 40. The hook members 66, 68 are then hooked over a rail of a respective magazine rack. Thus, the support members 18, 20 may be rotated as a unit with the newspapers and magazines supported thereby being secured against falling therefrom.

Accordingly, after a sufficient supply of newspaper 36 is contained within the newspaper containment structure 26, 28 the supply of tape 48 is removed from the storage compartment 46 and mounted on the base 12, as shown in FIG. 5. The elastic cords 62, 64 are then utilized to secure the newspapers to the containment structure 26, 28. Tape is pulled from the supply 48 and adhered to the newspaper 36. This adherence is within the space 30. Next, the support members 18, 20 along with the newspaper 36 are rotated as a unit so that the tape 48 encircles the newspaper 36 within the space 30 without interference from any of the structure of the unit 10, as shown in FIGS. 6 and 7. By the time the support members 18, 20 are returned to their original orientation, the tape 48 has completely encircled the newspaper 36, providing a secured bundle suitable for transport. The elastic cords 62, 64 are then released and the bundle of newspaper may be removed. The supply of tape 48 may then be returned to the storage compartment 46 and storage of newspaper may be resumed.

Figure 8:
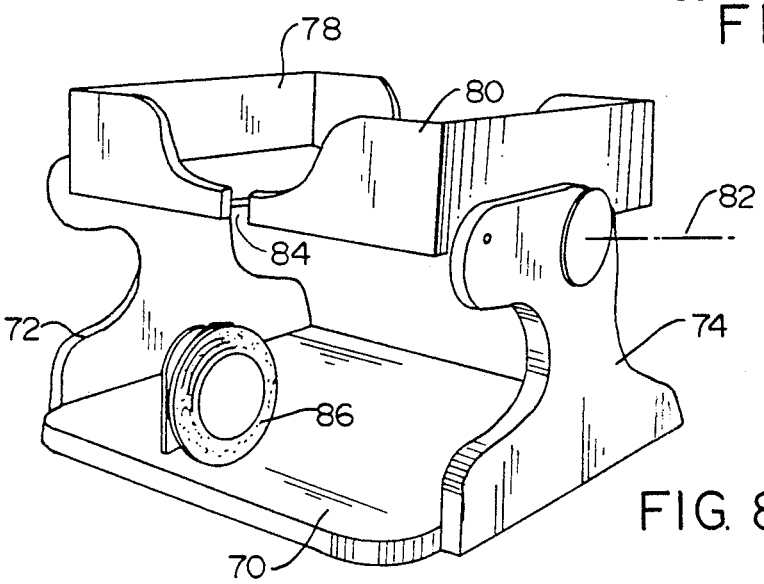
FIG. 8 is a perspective view of a second embodiment of an arrangement constructed in accordance with the principles of this invention.

FIGS. 1–7 illustrate an embodiment of the invention suitable for use in a residence. FIG. 8 illustrates an embodiment of this invention which is suitable for use in an office environment to hold trade papers, computer paper, and the like, for recycling. As shown in FIG. 8, the inventive arrangement includes a base 70 and side members 72, 74. Paper support trays 78, 80 are mounted in a cantilevered manner for rotation on the side members 72, 74, respectively, about a common axis 82. The trays 78, 80 are separated by a space 84, below which a supply of tape 86 is mounted on the base 70. The trays 78, 80 are releaseably secured against rotation by means not shown, and there is also provided, although not shown, some means for securing paper contained within the trays 78, 80 from falling from the trays when the trays together with the paper are rotated. Operation of the embodiment shown in FIG. 8 is similar to that for the embodiment shown in FIGS. 1–7 and no further description thereof need be given.

Although the described embodiments have been shown with supplies of paper tape, other bundling material may be provided such as, for example, twine.

Accordingly, there have been disclosed arrangements for storing and bundling recyclable material. While several illustrative embodiments have been disclosed, it will be apparent to one of ordinary skill in the art that various modifications and adaptations to the disclosed embodiments can be made without departing from the spirit and scope of this invention, which is only intended to be limited by the appended claims.

What is claimed is:

1. Apparatus for bundling newspapers and the like, comprising:

a base;

a pair of side members supported on said base and extending upwardly therefrom in spaced apart relation;

a pair of support members, each of said support members including a multi-sided structure having two adjacent sides open;

means for mounting said support members each on a respective one of said side members for independent rotation about an axis parallel to a first of said open sides, said mounting means holding said support members so that the other open sides of said support members are in parallel face-to-face relation and separated by a space, so that a newspaper can be passed through said first open sides of said support members and extend through said other open sides of bridge said space and be supported by both said support members;

means for securing a newspaper in said multisided structures of said pair of support members so that said pair of support members along with said newspaper may be rotated as a unit;

a supply of bundling material; and means for supporting said supply on said base in line with said space;

wherein a first of said support members includes means for storing said supply of bundling material.

2. The apparatus according to claim 1 wherein said supply includes a roll of adhesive backed tape.

3. The apparatus according to claim 1 further including:

means for releasably securing said pair of support members against rotation.

4. The apparatus according to claim 3 wherein said releasable securing means includes detent means between each of said pair of support members and its respective side member.

5. The apparatus according to claim 1 wherein said first support member is formed with a storage compartment having an open side and said supply of bundling material includes a base member and means for mounting said bundling material on said base member, wherein said base member also functions as a cover for said storage compartment to close the open side thereof.

6. The apparatus according to claim 1 wherein said securing means includes an elastic cord attached to one of said support members and extending over said first open side of said one support member.

7. Apparatus for bundling newspapers and the like, comprising:

a base;

a pair of side members supported on said base and extending upwardly therefrom in spaced apart relation;

a pair of support members;

first means for mounting in a cantilevered manner a first of said support members on a fist of said side members for rotation about an axis; and second means for mounting in a cantilevered manner the other of said support members on the other of said side members for rotation about said axis;

each of said support members including:

a planar wall parallel to said axis;

containment means on a first side of said wall, said containment means being open to said space; and rack means on the other side of said wall adapted to hold magazines and the like;

wherein said pair of support members extend toward each other from their respective side members with said pair of support members being separated by a space, said pair of support members being adapted to support a newspaper which bridges said space.

8. The apparatus according to claim 7 further including:

means for securing a newspaper in said pair of containment means and magazines in said rack means so that said pair of support members along with a newspaper bridging said space may be rotated as a unit.

9. The apparatus according to claim 8 wherein said securing means includes an elastic cord extending between one of said rack means over its respective planar wall and to the containment means on the other side of said planar wall.

10. The apparatus according to claim 7 further including: a supply of bundling material; and means for supporting said supply on said base in line with said space.

11. The apparatus according to claim 10 wherein said supply includes a roll of adhesive backed tape.

12. The apparatus according to claim 10 wherein a first of said support members includes means for storing said supply of bundling material.

13. The apparatus according to claim 12 wherein said first support member is formed with a storage compartment having an open side and said supply of bundling material includes a base member and means for mounting said bundling material on said base member, wherein said base member also functions as a cover for said storage compartment to close the open side thereof.

14. The apparatus according to claim 7 further including:

means for releasably securing said pair of support members against rotation.

15. The apparatus according to claim 14 wherein said releasable securing means includes detent means between each of said pair of support members and its respective side member.

* * * * *